US005447314A

United States Patent [19]

Yamazaki et al.

[11] Patent Number: 5,447,314

[45] Date of Patent: Sep. 5, 1995

[54] GOLF BALL LOCATING SYSTEM AND OPERATING METHOD

[76] Inventors: Tsuyoshi Yamazaki, 129 Steeler Dr., Las Vegas, Nev. 89128; Michael A. Minovitch, 2832 St. George St. #6, Los Angeles, Calif. 90027

[21] Appl. No.: 172,726

[22] Filed: Dec. 27, 1993

[51] Int. Cl.[6] ..... A63B 43/00

[52] U.S. Cl. ..... 273/213

[58] Field of Search ..... 273/213, 187.3, 58 G, 273/32 H

[56] References Cited

U.S. PATENT DOCUMENTS

| | | | |
|---|---|---|---|
| 1,620,290 | 3/1927 | Rubin | 273/213 |
| 3,782,730 | 1/1974 | Horchler | 273/213 |
| 5,054,785 | 10/1991 | Gobush et al. | 273/187.1 X |
| 5,112,055 | 5/1992 | Barnhill | 273/213 |

FOREIGN PATENT DOCUMENTS

| | | | |
|---|---|---|---|
| 1172449 | 11/1969 | United Kingdom | 273/213 |

*Primary Examiner*—George J. Marlo
*Attorney, Agent, or Firm*—Christie, Parker & Hale

[57] ABSTRACT

A sound emitting golf ball is provided for locating a golf ball after it is struct by a golf club. The system comprises a miniaturized electronic, battery powered piezoelectric sound generator surrounded by a shock absorber that is embedded inside a golf ball. The sound generating system is constructed with very small, inexpensive shock resistant components and embedded at the center of the golf ball inside the shock absorber. The system can be designed to operate in the audible or ultrasonic range.

9 Claims, 4 Drawing Sheets

GOLF BALL LOCATING SYSTEM AND OPERATING METHOD

BACKGROUND

Many times when a golf ball is hit over a considerable distance by a golf club during the course of a game of golf, it lands in bushes, high grass or behind a tree and can be difficult to find. If the ball can not be located, the golfer is penalized by two strokes and continues the game with another ball. However, if the ball is designed to emit a sound signal, it will be relatively easy to find thereby enabling the golfer to avoid the two stroke penalty. The present invention provides such a ball.

BRIEF SUMMARY OF THE INVENTION

Thus, in the practice of this invention, the presently preferred embodiment typically comprises a miniaturized ultrasonic transducer and a miniaturized passive magnetometer (a micromagnetometer) which serves as an internal on-off switch for the ultrasonic transducer. These components are mounted adjacent a microbattery and encased within a spherical shock absorber. The shock absorber is embedded at the center of a golf gall and has a diameter of a few millimeters. A system of small holes radiate outward from the ultrasonic transducer, through the shock absorber, and through the walls of the golf ball for carrying the sound waves out of the ball. The ultrasonic sound waves emitted by the golf ball are detected by a small, hand-held battery operated, ultrasonic sensing system. The sensing system is equipped with a microprocessor chip that processes the changing intensity of the received signal while the system is carried over the ground. The microprocessor generates directional information from the varying signal intensity that is displayed on a small LCD screen mounted on the sensing system. The ball is located by switching on the ultrasonic sensing system when the golfer reaches the approximate location of the ball and following the directional signals displayed on the LCD screen. The ultrasonic sound generator in the golf ball is turned off by passing a small permanent magnet over the ball. This will provide a means for prolonging the battery life of the golf ball when the locating system is not needed. The sound generator inside the golf ball is turned on by passing the permanent magnet close to the ball.

DRAWINGS

These and other advantages and features of the invention will be apparent from the disclosure, which includes the specification with the foregoing and ongoing description, the claims and the accompanying drawings wherein:

DESCRIPTION OF THE PREFERRED EMBODIMENT

As described above, the present invention provides a method and operating system for locating a golf ball after it is hit by a golf club. Basically, the method involves designing the ball with a sound emitter so that the ball can be located by tracking the emitted sound it produces. In the preferred embodiment the sound emitted by the golf ball is in the ultrasonic range, inaudible to human hearing so as to not disturb other near-by golfers. The ball is located by a small hand-held ultrasonic sensor operating on the same frequency.

Figure 1:
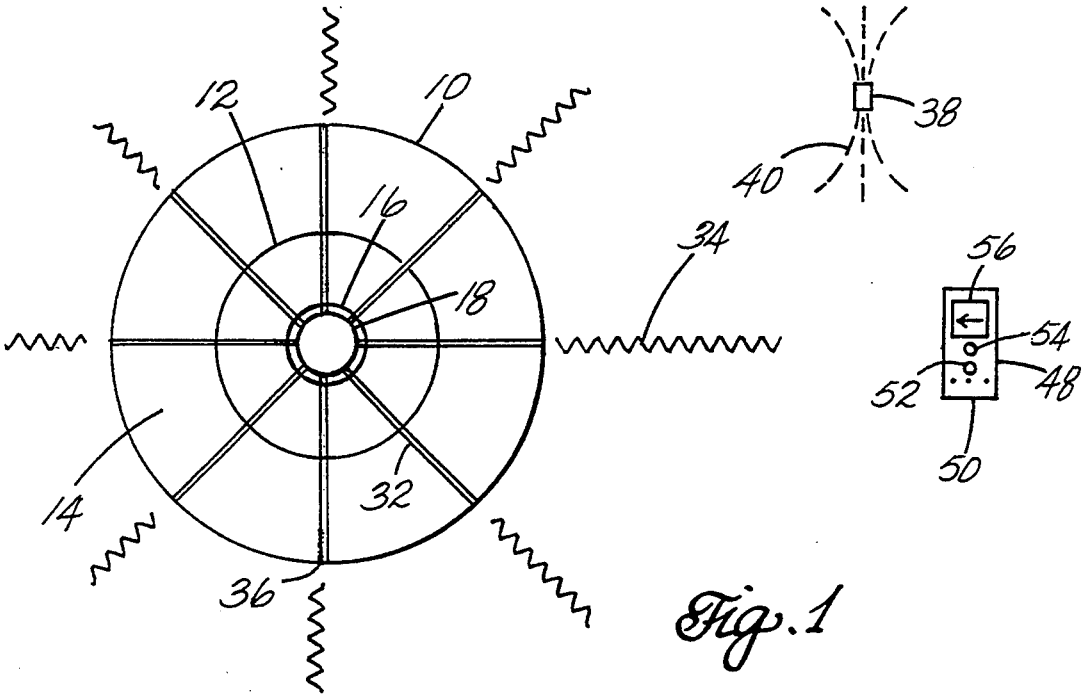
FIG. 1 is a schematic transverse cross-section of a sound emitting golf ball illustrating the design and construction of the preferred embodiment of the invention.
Figure 2:
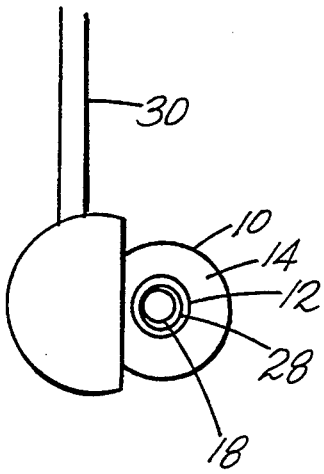
FIG. 2 is a schematic transverse cross-section of a sound emitting golf ball at the instant it is struct by a golf club.
Figure 3:
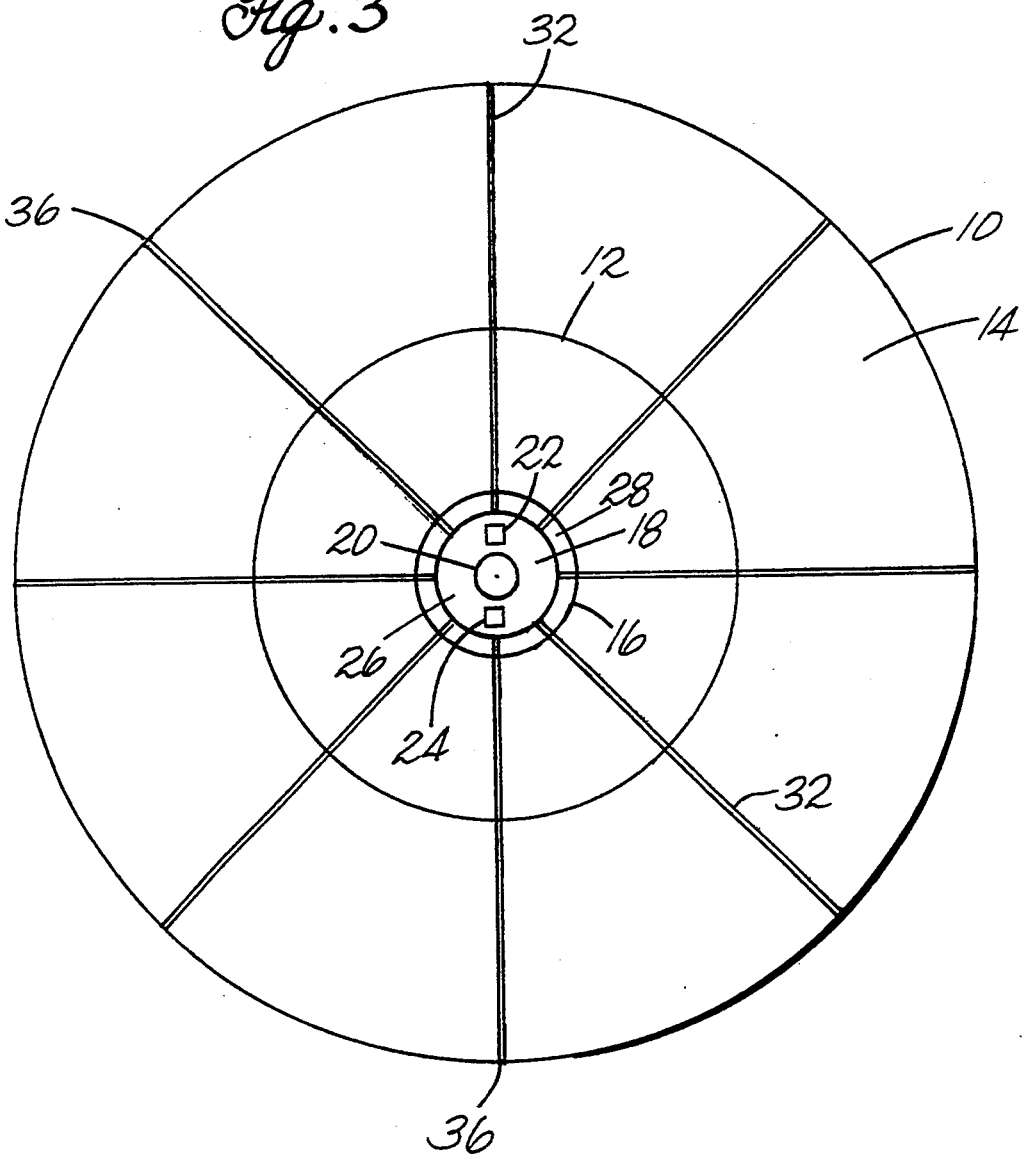
FIG. 3 is an enlarged schematic transverse cross-section of the ultrasonic sound generating system embedded inside the golf ball further illustrating the design and construction of the preferred embodiment.

Referring to FIGS. 1, 2, and 3, the golf ball 10 is essentially an ordinary golf ball with an inner elastic core 12 surrounded by an outer layer 14. The elastic core 12 contains a small central cavity 16. This cavity 16 contains the sound generating system 18.

In the preferred embodiment the sound generating system 18 comprises a miniaturized piezoelectric ultrasonic transducer 20, a micro-battery 22, and a passive micromagnetometer 24 mounted on a supporting frame 26 as shown in FIG. 3. The assembly is surrounded by a shock absorbing material 28 that is fitted, snugly, inside the central cavity 16. The sound generating system 18, mounting frame 26, and shock absorber 28 is designed to withstand a relatively high acceleration that is produced when the ball 10 is hit hard by a golf club 30 as shown in FIG. 2. A system of radiating small diameter holes 32, carry the sound waves 34 produced by the ultrasonic transducer 20 out of the ball. A system of thin diaphragms 36 are mounted across the holes 32 to keep water and other substances from entering the cavity 16 of the sound generating system 18.

Figure 4:
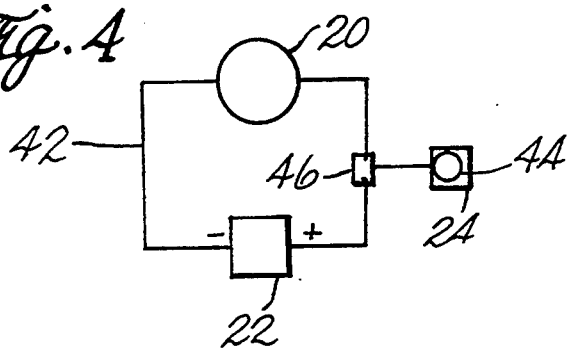
FIG. 4 is a schematic circuit diagram illustrating the design of the magnetometer on-off switch for activating the sound generating system inside the golf ball.

The micromagnetometer 24 serves as a simple on-off switch for activating the sound generating system 18 without physically contacting the golf ball 10. When a small permanent magnet 38 is placed next to the ball 10, its magnetic field 40 is sensed by the magnetometer 24. As is shown schematically in FIG. 4, the circuit 42 of this on-off system is designed such that when the search coil 44 of the magnetometer 24 picks up the presence of a magnetic field 40 (by an induced current in the search coil 44) a switch 46 connecting the battery 22 to the ultrasonic transducer 20 is closed (opened) which sends (cuts) current from the battery 22 to the transducer 20 thereby turning it on (off). Thus, before a golfer "tees-off", the golfer passes a small permanent magnet 38 close to an un-activated golf ball 10 to turn on the internal sound generating system 18. After the ball is found, it can be turned off by once again passing the permanent magnet 38 close to the ball's surface. This non-contacting on-off switching system reduces battery drain thereby allowing a sound generating golf ball described in the preferred embodiment to be used for several years.

If the ball 10 is not visible after being hit, it is found by a small hand-held, battery operated, ultrasonic sensor 48. In the preferred embodiment, the ultrasonic sensor 48 is mounted on a small, relatively thin, cardlike mounting frame 50, with a built-in replaceable battery 52 that can be easily carried in a shirt pocket. The sensor 48 is designed to measure the intensity of the received ultrasonic signals 34 emitted from the golf ball 10 and transmit the data electronically to a microprocessor chip 54 embedded inside the frame 50. The microprocessor 54 is designed to analyze the intensity data and determine the approximate range and direction of the ball 10. This information is displayed on a small LCD screen 56 built into the mounting frame 50.

The detailed design and construction of the ultrasonic sound generating system 18 and the ultrasonic receiver 48 are omitted because this technology is well known in the art of microelectronics. For example, the piezoelectric ultrasonic transducers described in U.S. Pat. Nos. 4,800,317 and 4,859,897 entitled "Ultrasonic Transducer Method and Apparatus", and "Directional Waterproof Ultrasonic Transducer For Operating in Air", respectively, could be used for the sound generator 18. The ultrasonic sensor described in U.S. Pat. No. 4,906,886, could be used in the ultrasonic receiving system 48.

Figure 5:
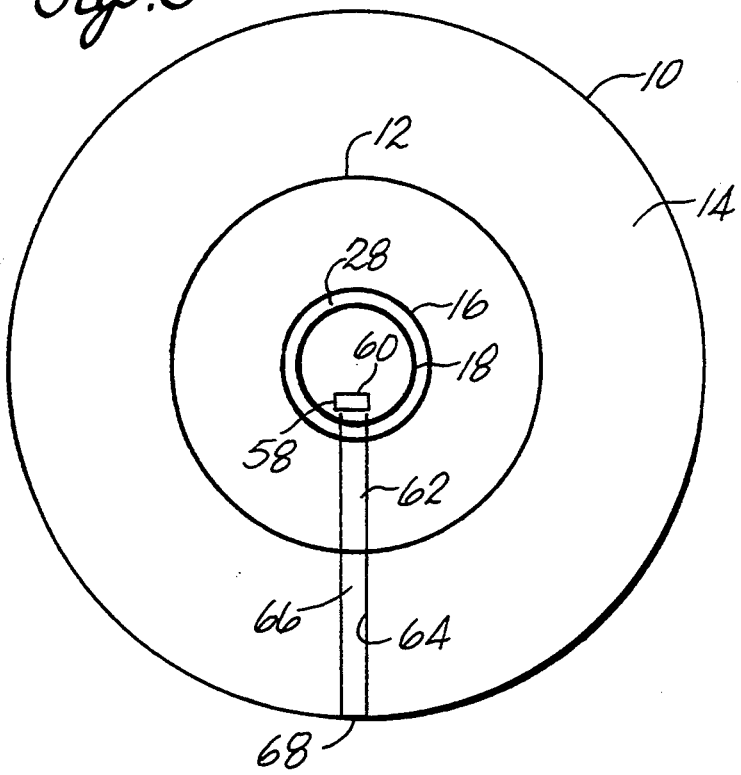
FIG. 5 is a schematic transverse cross-section of an audible sound emitting golf ball illustrating an alternative design and construction of the invention.

FIG. 5 is a schematic cross-section illustrating an alternative embodiment of the invention. In this embodiment, the battery 58 is mounted in a separate compartment 60 inside the golf ball 10 and is designed to be replaceble. A removable plug 62 adjacent the battery 56 has threaded walls 64 that screw into a cylinderical cavity 66 extending into the ball. A slot 68 on top of the plug 62 is provided for a screwdriver. When the battery 58 inside the golf ball 10 becomes weak, this embodiment allows it to be replaced without throwing the ball away (with its sound generating system).

Figure 6:
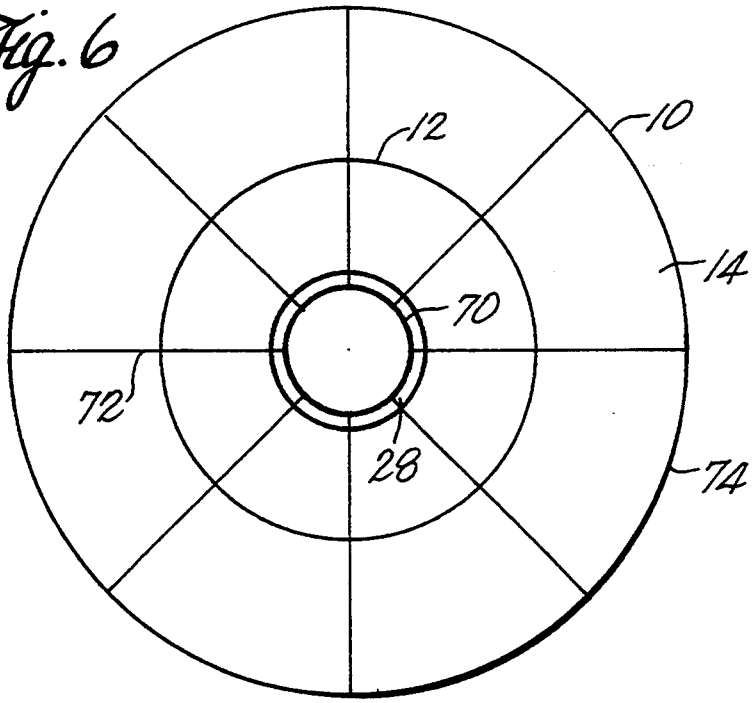
FIG. 6 is a schematic transverse cross-section of a sound emitting golf ball illustrating another embodiment of the invention.

FIG. 6 is a schematic cross-section illustrating another alternative embodiment of the invention. In this embodiment, the sound generated by the transducer 70 inside the ball is designed to be in the audible range. In this embodiment a sound sensing system is not necessary. The sound generated by the transducer 70 can be carried out of the ball through holes 32 shown in FIGS. 1 and 3, or it can be carried by small vibrating fibers 72 as shown in FIG. 6. These fibers 72 are connected to the transducer 70, pass through the core 12 and outer layer 14 of the ball and terminate underneath the outer surface 74 (skin) of the ball 10 thereby eliminating the holes 32 described in the previous embodiment. Miniaturized audible piezoelectric transducers are well known in the art. (See, for example, U.S. Pat. Nos. 5,030,872 and 4,820,952 entitled "Electro-Acoustic Transducer", and "Film-Speaker Using a Piezo-Electric Element", respectively.)

Figure 7:
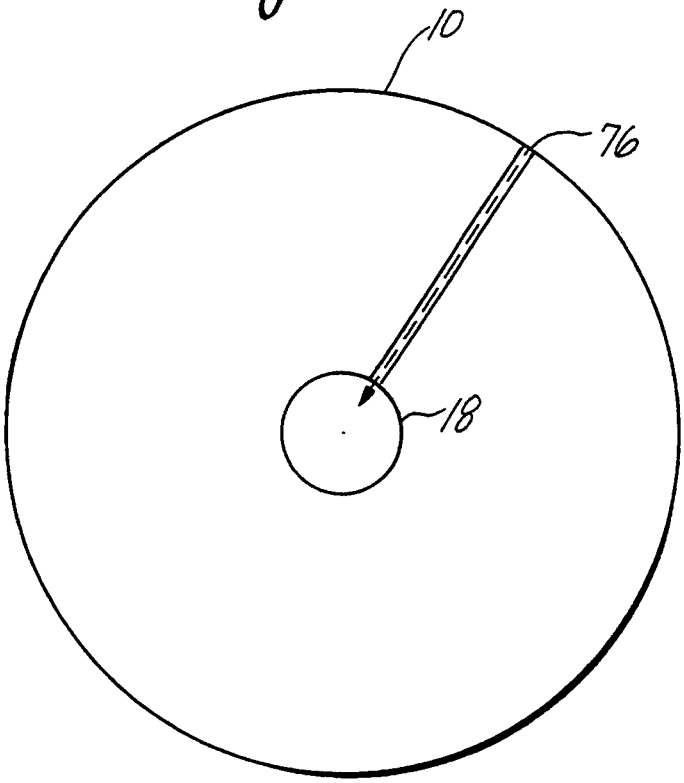
FIG. 7 is a schematic transverse cross-section of a sound emitting golf ball with a manual on-off switch.

FIG. 7 is a schematic cross-section of another alternative embodiment of the invention. In this embodiment, the on-off switch is controlled by a small screw 76 that can be turned manually by a small screwdriver.

Many other embodiments are possible. For example, the sound generating system inside the ball (which may or may not be audible) can be activated after the ball is hit by a miniaturized sound sensing system tuned to a certain frequency (or frequency range). This system would replace the micromagnetometer 24 described in the preferred embodiment shown in FIGS. 1 and 3.

Other embodiments are possible where the entire sound generating system inside the ball is mounted inside a small plug and designed to be removable. If the outer surface of the ball becomes damaged, the sound generating system can be removed and inserted into an undamaged ball.

In another embodiment, the on-off switch can be controlled by a miniaturized automatic timing system. After the ball is hit, the timing system can be designed to turn on (or off) the sound generating system after a certain time interval. The miniaturized timing system could be similar to the one disclosed in U.S. Pat. No. 4,843,263 entitled "Clock Timing Controller For A Plurality Of LSI Chips."

Still other embodiments are possible by combining different elements of the various embodiments described above.

Many modifications and variations of the above embodiments can be devised by one skilled in the art without departing from the scope of the invention. Thus, it is intended that all matter contained in the above description or shown in the accompanying drawings should be interpreted as illustrative and not in a limiting sense.

What is claimed is:

1. A system for locating a golf ball comprising:

a golf ball;

ultrasonic sound generating means operating at a frequency above the range of human hearing;

means for mounting said ultrasonic sound generating means in said golf ball and ultrasonic sensor means for receiving the ultrasonic sound emitted from said golf ball for locating said golf ball.

2. A system as set forth in claim 1 wherein said ultrasonic sound generating means is embedded inside said golf ball and further comprising shock absorber means mounted around said ultrasonic sound generating means for absorbing the shock generated by hitting the golf ball with a golf club.

3. A system as set forth in claim 1 wherein said ultrasonic sound generating means comprises an ultrasonic piezoelectric transducer, battery means for energizing said ultrasonic transducer and switching means for turning said ultrasonic transducer on and off.

4. A system as set forth in claim 3 wherein said switching means further comprises magnetometer means for sensing a magnetic field and electronic circuit means connecting said magnetometer means to said ultrasonic transducer means so that said ultrasonic sound emitted by said golf ball can be turned on and off by passing a magnetic field close to said golf ball.

5. A method for locating a golf ball comprising the step of mounting an ultrasonic sound generating means on said golf ball so that said golf ball can be located by tracking the ultrasonic sound emitted by said golf ball.

6. A method as set forth in claim 5 further comprising the steps of:

mounting a shock absorber means around said ultrasonic sound generating means; and mounting said shock absorber means containing said ultrasonic sound generating means in a cavity inside said golf ball.

7. A method as set for in claim 6 further comprising the step of conveying the ultrasonic sound generated inside the ball outside the ball.

8. A method as set forth in claim 5 wherein said sound generating means comprises a piezoelectric ultrasonic transducer means further comprising the step of tracking the sound emitted by the transducer means by an ultrasonic sensor means.

9. A method as set forth in claim 5 further comprising the step of activating said ultrasonic sound generating means without making physical contact with the ball.

* * * * *